US008848963B2

(12) United States Patent
Menyhart et al.

(10) Patent No.: US 8,848,963 B2
(45) Date of Patent: Sep. 30, 2014

(54) MICROPHONE ARRANGEMENT FOR A BREATHING MASK

(71) Applicant: Savox Communications Oy Ab (Ltd), Espoo (FI)

(72) Inventors: Jorge Menyhart, Vancouver (CA); Edwin F. Poppert, II, Lincoln, NE (US)

(73) Assignee: Savox Communications Oy Ab (Ltd), Espoo (FI)

( * ) Notice: Subject to any disclaimer, the term of this patent is extended or adjusted under 35 U.S.C. 154(b) by 10 days.

(21) Appl. No.: 13/716,764

(22) Filed: Dec. 17, 2012

(65) Prior Publication Data

US 2013/0156246 A1 Jun. 20, 2013

(30) Foreign Application Priority Data

Dec. 19, 2011 (FI) ..... 20116286

(51) Int. Cl.
*H04R 1/04* (2006.01)

(52) U.S. Cl.
CPC ..... *H04R 1/04* (2013.01)
USPC ..... 381/367; 381/355; 381/181

(58) Field of Classification Search
CPC ..... H04R 1/04; H04R 1/28; H04R 1/38; A62B 18/08; G10L 21/02
USPC ..... 381/367, 355, 361, 346, 174, 369, 381/178–181
See application file for complete search history.

(56) References Cited

U.S. PATENT DOCUMENTS

| | | | |
|---|---|---|---|
| 4,340,787 | A | 7/1982 | Goerike |
| 4,736,740 | A | 4/1988 | Parker et al. |
| 4,858,719 | A | 8/1989 | Fidi et al. |
| 5,572,990 | A | 11/1996 | Berlin |
| 2003/0224838 | A1 | 12/2003 | Skillicorn et al. |
| 2005/0069156 | A1 | 3/2005 | Haapapuro et al. |
| 2009/0192799 | A1 | 7/2009 | Griffin et al. |
| 2010/0142743 | A1 | 6/2010 | Tanaka et al. |

FOREIGN PATENT DOCUMENTS

| | | |
|---|---|---|
| EP | 1 685 877 | 8/2006 |
| GB | 2 415 316 A | 12/2005 |
| GB | 2 421 443 A | 6/2006 |

OTHER PUBLICATIONS

European Search Report in corresponding application 12196683.2-1910 dated Mar. 26, 2013.
Finnish Search Report, dated Oct. 12, 2012, from corresponding Finnish application.

*Primary Examiner* — Tuan D Nguyen
(74) *Attorney, Agent, or Firm* — Young & Thompson

(57) ABSTRACT

An electro-acoustical transducer device includes a body structure (101) and a differential microphone (102) located in an aperture of a wall of the body structure. The microphone includes a front side for receiving an acoustical signal and a rear side for receiving the acoustical signal in modified form. The differential microphone is arranged to produce an electrical output signal proportional to the difference of the acoustical signals at the front and rear sides. The body structure is arranged to form a chamber (105) shared with the rear side of the microphone. There are tubular channels (107) to the chamber so that the channels and the chamber constitute an acoustical filter for filtering the acoustical signal falling to the rear side of the microphone. With proper design of the chamber and the channels, it is possible to achieve acoustical filtering for background noise rejection.

13 Claims, 5 Drawing Sheets

MICROPHONE ARRANGEMENT FOR A BREATHING MASK

FIELD OF THE INVENTION

The invention relates to an electro-acoustical transducer device comprising a microphone. The invention further relates to an apparatus comprising a breathing mask and an electro-acoustical transducer device engaged to the breathing mask.

BACKGROUND

A breathing mask and other safety equipment can be equipped with or connected to a communication device in order to enable the user of the breathing mask to communicate with other persons. For example, a fire fighter wearing a breathing mask has to be able to communicate with other fire fighters of his team and with fire chiefs. Examples where a breathing mask is equipped with a radio communication device are described, for example, in publications GB2415316 and GB2421443. The communication device comprises an electro-acoustical transducer device that includes a microphone and possibly also a speaker element.

The internal acoustics of breathing masks is notoriously bad. In addition, the speech may often undergo further degradation from radio transmission, external voice amplifiers, telephony, and other aspect of the kind mentioned above and related to the transmission and/or the signal conversion between the electrical and acoustical forms. Furthermore, there may be a significant level of background noise for example in a working area of a user of a breathing mask. Therefore, there is a need to suppress such signal frequencies which represent the noise with respect to the signal frequencies which represent the speech so as to make the speech clearer in order to avoid potential communication problems. The clarity of speech is important because it might cause even a dangerous situation if speech of e.g. a fire fighter is misunderstood by his team and/or by fire chiefs. The suppression of the signal frequencies which represent the noise can be implemented with an electrical filter connected to the output of the microphone. The electrical filter, however, requires electrical power which is a critical factor especially in battery operated devices such as a communication device integrated with or connected to a breathing mask or other portable safety equipment.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

In accordance with the first aspect of the invention, there is provided a new electro-acoustical transducer device that can be used, for example but not necessarily, in a communication device integrated with or connected to a breathing mask or other portable safety equipment. The electro-acoustical transducer device comprises:

a body structure, and a differential microphone located in an aperture of a first wall of the body structure, wherein:

the differential microphone comprises a front side for receiving an acoustical signal and a rear side for receiving the acoustical signal in modified form and the differential microphone is arranged to produce an electrical output signal substantially proportional to a difference of the acoustical signal at the front side and the acoustical signal at the rear side, and the body structure is arranged to form a chamber shared with the rear side of the differential microphone and there is at least one tubular channel in the first wall of the body structure to the chamber so that the at least one channel and the chamber constitute an acoustical filter for filtering the acoustical signal received by the rear side of the differential microphone, and wherein the electro-acoustical transducer device further comprises a vented cover element allowing both the front side of the differential microphone and the opening of the at least one first tubular channel to receive the acoustical signal in the same, undifferentiated form.

The combination of the chamber and the channels can be dimensioned, i.e. tuned, so that the acoustical filter is a low-pass filter which is applied to the acoustical signal received by the rear side of the differential microphone. Because the differential microphone is arranged to produce the electrical output signal substantially proportional to the difference between the acoustical signal at the front side and the filtered acoustical signal at the rear side, the net result is a high-pass filtering effect on the signal path between the incoming acoustical signal and the electrical output signal of the differential microphone. Therefore, the low frequency noise content, which is typically caused by poor acoustics, breathing noise, and/or forced air flow noise such as fan noise, can be reduced significantly without an electrical filter at the output of the microphone.

In order to provide more complex frequency responses, the body structure can be further arranged to form at least one additional chamber and in each wall between adjacent chambers there can be at least one tubular channel. The numbers and dimensions of the chambers and the channels can be specifically manipulated to achieve a desired frequency response for the filtering effect on the signal path between the incoming acoustical signal and the electrical output signal.

In accordance with the second aspect of the invention, there is provided a new apparatus that comprises a breathing mask and an electro-acoustical transducer device according to the invention, wherein the electro-acoustical transducer device is engaged to the breathing mask. The breathing mask may comprise two filter ports, located on opposite sides of the breathing mask. A filter in the form of a canister can be screwed onto either filter port, allowing the user of the breathing mask to breathe filtered air. The electro-acoustical transducer device can be, for example but not necessarily, screwed onto the other filter port of the breathing mask.

A number of exemplifying embodiments of the invention are described in accompanied dependent claims.

Various embodiments of the invention both as to constructions and to methods of operation, together with additional objects and advantages thereof, will be best understood from the following description of specific embodiments when read in connection with the accompanying drawings.

The verb "to comprise" is used in this document as an open limitation that neither requires nor excludes the existence of also unrecited features. The features recited in depending claims are mutually freely combinable unless otherwise explicitly stated.

BRIEF DESCRIPTION OF THE FIGURES

Embodiments of the invention presented in the sense of examples and their advantages are explained in greater detail below with reference to the accompanying drawings, in which.

DESCRIPTION OF THE EXEMPLIFYING EMBODIMENTS

Figure 1A:
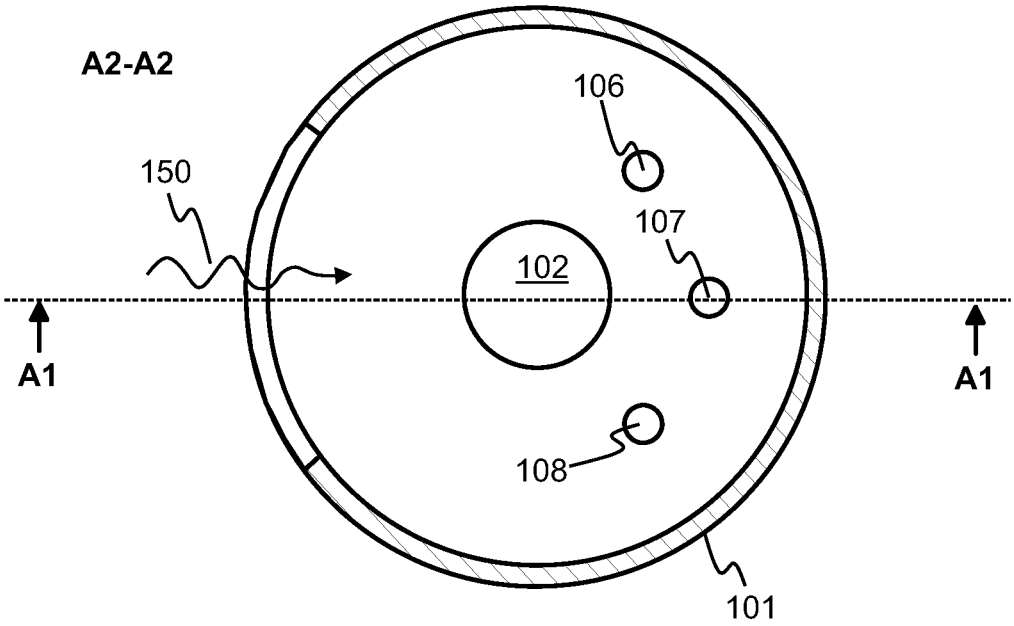
FIGS. 1*a* and 1*b* show schematic section views of an electro-acoustical transducer device according to an exemplifying embodiment of the invention.
Figure 1B:
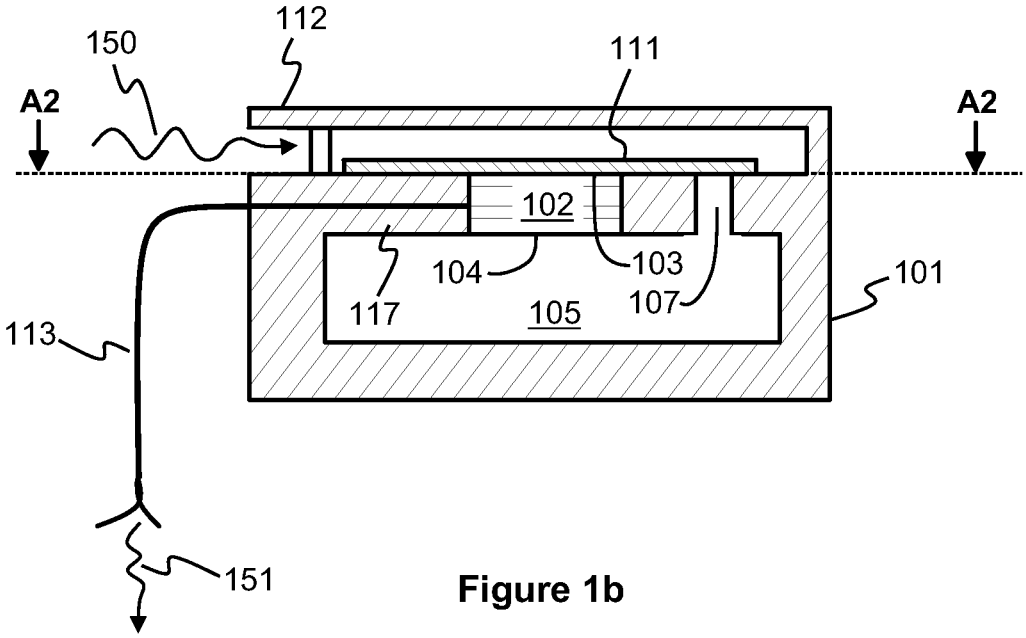

FIGS. 1*a* and 1*b* show schematic section views of an electro-acoustical transducer device according to an exemplifying embodiment of the invention. FIG. 1*b* shows a section taken along the line A2-A2 shown in FIG. 1*b*. FIG. 1*b*, in turn, shows a section taken along the line A1-A1 shown in FIG. 1*a*. The electro-acoustical transducer device comprises a body structure 101 and a differential microphone 102 located in an aperture of a first wall 117 of the body structure. The differential microphone comprises a front side 103 for receiving an acoustical signal 150 and a rear side 104 for receiving the acoustical signal in modified form. The modification is due to the propagation of the acoustical signal from the front side to the rear side. The differential microphone is arranged to produce an electrical output signal 151 that is substantially proportional to a difference of the acoustical signal at the front side 103 and the acoustical signal at the rear side 104. The electro-acoustical transducer device comprises an electrical wire 113 for connecting the electrical output signal 151 to an external device that can be, for example, a radio transceiver. The body structure 101 is arranged to form a chamber 105 that is shared with the rear side 104 of the differential microphone 102. Furthermore, the body structure is arranged to form first tubular channels 106, 107, and 108 leading to the chamber 105. The chamber 105 and the channels 106-108 can be dimensioned, i.e. tuned, so that they constitute an acoustical low-pass filter which is applied to the acoustical signal falling to the rear side 104 of the differential microphone. Furthermore, the number and/or locations of the channel/channels leading to the chamber 105 can be varied so as to obtain a desired filtering effect. Because the differential microphone 102 is arranged to produce the electrical output signal 151 substantially proportional to the difference between the acoustical signal falling to the front side 103 and the acoustical signal falling to the rear side 104, the net result is a high-pass filtering effect on the signal path between the incoming acoustical signal 150 and the electrical output signal 151 of the differential microphone. Therefore, the low frequency noise content, which is typically caused by poor acoustics, breathing noise, and/or forced air flow noise such as fan noise, can be reduced significantly. Another advantageous effect of the above-described acoustical arrangement, where the high-pass filtering effect is achieved, is that the low-frequency mechanical excursion of the microphone diaphragm is limited. This allows the mask wearing operator to speak normally, or yell and shout, without creating typical distortion from high volume. It should be noted that the limiting of the physical movement of the diaphragm cannot be implemented with an electrical filter connected to the output of the microphone.

The differential microphone 102 can be, for example, a noise-cancelling electret condenser microphone "ECM" where the difference between the acoustical signals falling to the front and rear sides of the ECM creates a net pressure to the diaphragm of the ECM. An ECM is based on stable dielectric material with permanently-embedded static electric charge which, due to the high resistance and chemical stability of the material, will not decay for hundreds of years. The name "electret" comes from electrostatic and magnet; drawing analogy to the formation of a magnet by alignment of magnetic domains in a piece of iron. Electrets are commonly made by first melting a suitable dielectric material such as a plastic or wax that contains polar molecules, and then allowing it to re-solidify in a powerful electrostatic field. The polar molecules of the dielectric align themselves to the direction of the electrostatic field, producing a permanent electrostatic bias.

It is also possible that the differential microphone 102 comprises two single-input microphones and an electrical circuitry for forming a difference of electrical output signals of these two single-input microphones. One of the single-input microphones is arranged to receive the acoustical signal from the chamber 105 and the other of them is arranged to receive the acoustical signal from the opposite side of the wall 117 of the body structure supporting the microphones.

An electro-acoustical transducer device according to an exemplifying embodiment of the invention further comprises an acoustical resistor element 111 arranged to cover the front side 103 of the differential microphone 102 and/or the opening of at least one of the channels 106-108. The differential microphone 102 can be mounted to be flush with the surrounding body structure so that its front side 103 is in contact with the acoustical resistor element 111 as illustrated in FIG. 1*b*.The chamber 105, the channels 106-108, and the acoustical resistor element 111 can be designed, i.e. tuned, for achieving a desired filtering effect that is suitable for a sonic environment of, for example, a particular breathing mask or another device. In the exemplifying case illustrated in FIG. 1*b*, the acoustical resistor element 111 covers the front side of the differential microphone and the openings of all of the channels 106-108. Different filtering effects can be achieved in the cases wheresome of the openings of the channels 106-108 and/or the front side of the differential microphone are uncovered and some of them are covered. The acoustical resistor element 111 can be made of, for example, plastics.

An electro-acoustical transducer device according to an exemplifying embodiment of the invention further comprises a vented cover element 112 allowing both the front side 103 of the differential microphone 102 and the openings of the channels 106-108 to receive the acoustical signal in the same, undifferentiated form. The vented cover element 112 can be designed to reduce low-frequency wind turbulences which might cause excessive mechanical excursion in the microphone diaphragm and low-frequency distortion that may produce audible distortion due to non-linearities. Furthermore, the vented cover element aids in reducing vapor build-up from the operator's breath.

An electro-acoustical transducer device according to an exemplifying embodiment of the invention comprises fastening elements for releasably engaging the electro-acoustical transducer device to an external device. The fastening elements can be, for example, threads on the surface of the body structure for releasably engaging the electro-acoustical transducer device to corresponding threads of a filter port of a breathing mask. The electro-acoustical transducer device may further comprise a seal element for providing a gas-tight joint between the electro-acoustical transducer device and an external device e.g. a breathing mask.

Figure 2A:
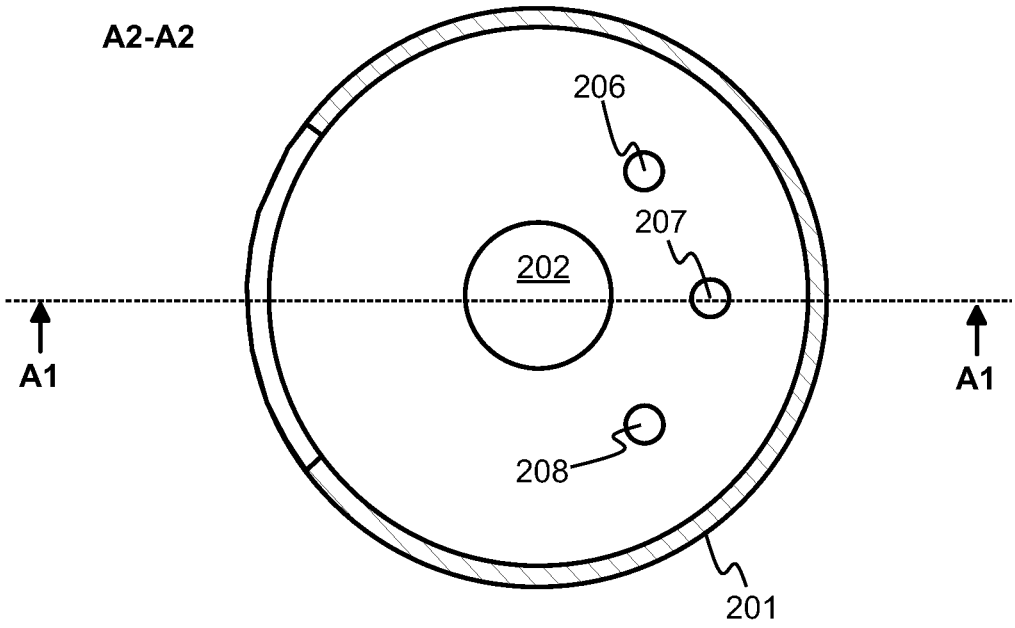
FIGS. 2*a* and 2*b* show schematic section views of an electro-acoustical transducer device according to another exemplifying embodiment of the invention.
Figure 2B:
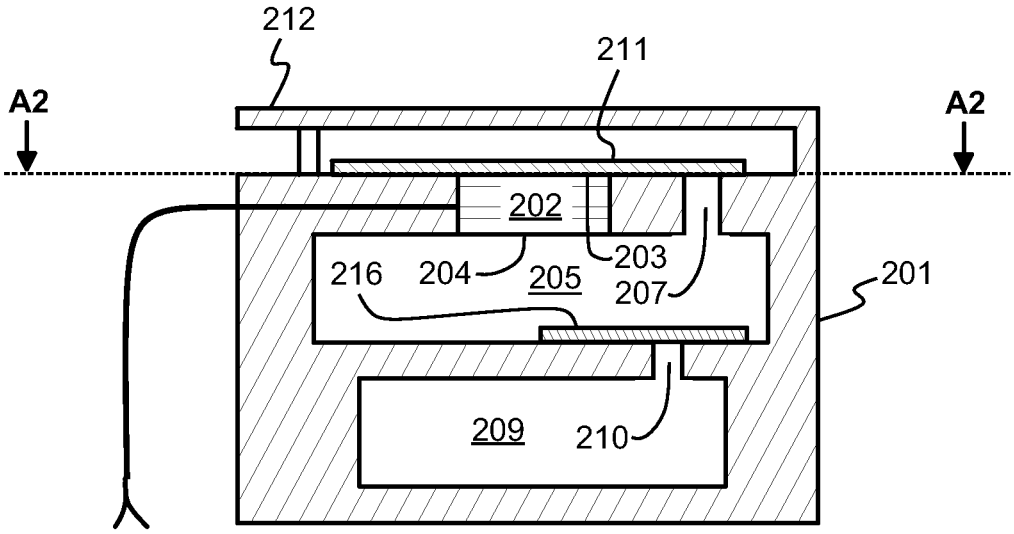

FIGS. 2*a* and 2*b* show schematic section views of an electro-acoustical transducer device according to an exemplifying embodiment of the invention. FIG. 2*b* shows a section taken along the line A2-A2 shown in FIG. 2*b*. FIG. 2*b*, in turn, shows a section taken along the line A1-A1 shown in FIG. 2*a*.The electro-acoustical transducer device comprises a body structure 201 and a differential microphone 202 located in an aperture of a first wall of the body structure. The differential microphone comprises a front side 203 for receiving an acoustical signal and a rear side 204 for receiving the acoustical signal in modified form. The body structure 201 is arranged to form a chamber 205 that is shared with the rear side 204 of the differential microphone 202 and an additional chamber 209. The body structure is further arranged to form first tubular channels 206, 207, and 208 leading to the chamber 205 and at least one second tubular channel 210 between the chambers 205 and 209. The above-presented arrangement having the two chambers as illustrated in FIG. 2*b* is advantageous in cases where there is a need for band-pass filtering "BPF" with a narrow notch-response above the desired BPF frequency band for removing an undesired peak from the frequency response. In certain circumstances, some mid-low frequency areas of speech were found to be natural sounding and the above-mentioned desired frequency band is to be defined so that it covers these mid-low frequency areas. The above-mentioned notch-response is created acoustically with the aid of the additional chamber 209 that is acoustically connected to the chamber 205 via the at least one second channel 210. The front side 203 of the differential microphone 202 and/or the openings of some or all of the first channels 206-207 can be covered with an acoustical resistor element 211 with the aid of which the frequency response can be tuned. Furthermore, the openings of some or all of the one or more second channels can be covered with an acoustical resistor element 216 with the aid of which the frequency response can be tuned. A vented cover element 212 allows both the front side 203 of the differential microphone and the openings of the first channels 206-208 to receive an undifferentiated audio.

It should be noted that the number of the chambers in electro-acoustical transducer devices according to various embodiments of the invention is not limited to two. The body structure can be arranged to form more than two chambers and to form different arrangements of channels for acoustically connecting the chambers to each other and to the area receiving the incoming acoustical signal. With different numbers of the chambers and with different arrangements of the channels, different acoustical filters can be applied to the acoustical signal falling to the rear side of the differential microphone in order to achieve a desired overall frequency response which may resemble a frequency response of a complex electrical filter.

Figure 3A:
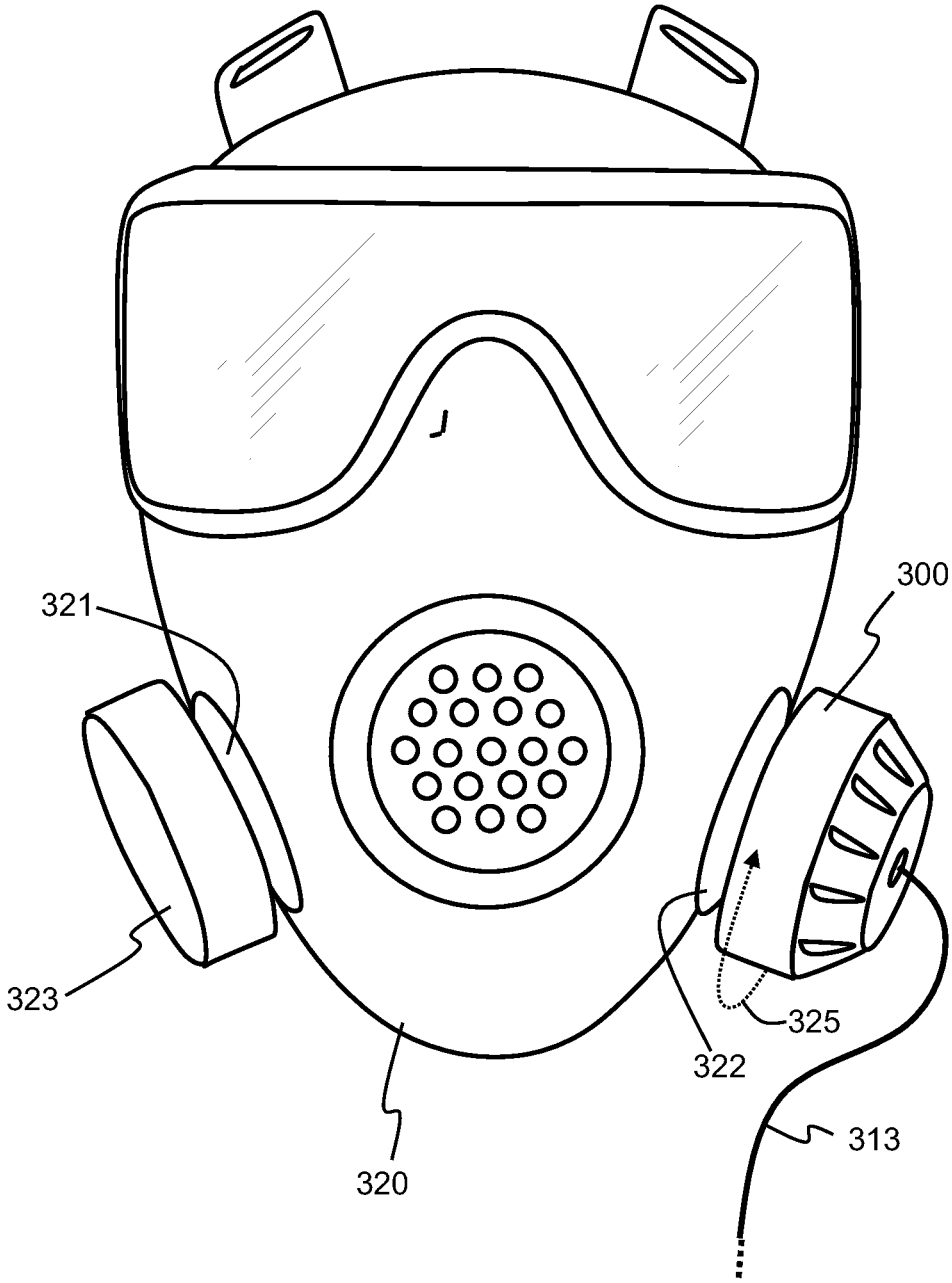
FIGS. 3*a* and 3*b* illustrate apparatuses that comprise a breathing mask and an electro-acoustical transducer device according to an exemplifying embodiment of the invention.

FIG. 3*a* illustrates an apparatus that comprise a breathing mask 320 and an electro-acoustical transducer device 300 according to an exemplifying embodiment of the invention. The breathing mask comprises two filter ports 321 and 322, located on opposite sides of the breathing mask. A filter 323 in the form of a canister has been screwed onto the filter port 321, allowing the user of the breathing mask to breathe filtered air. The electro-acoustical transducer device 300 has been screwed onto the filter port 322 of the breathing mask. The electro-acoustical transducer device 300 can be connected with the aid of the electrical wire 313 to an external device that can be, for example, a radio transceiver. The dashed arrow 325 illustrates the screwing of the electro-acoustical transducer device 300 onto the filter port 322 of the breathing mask.

Figure 3B:
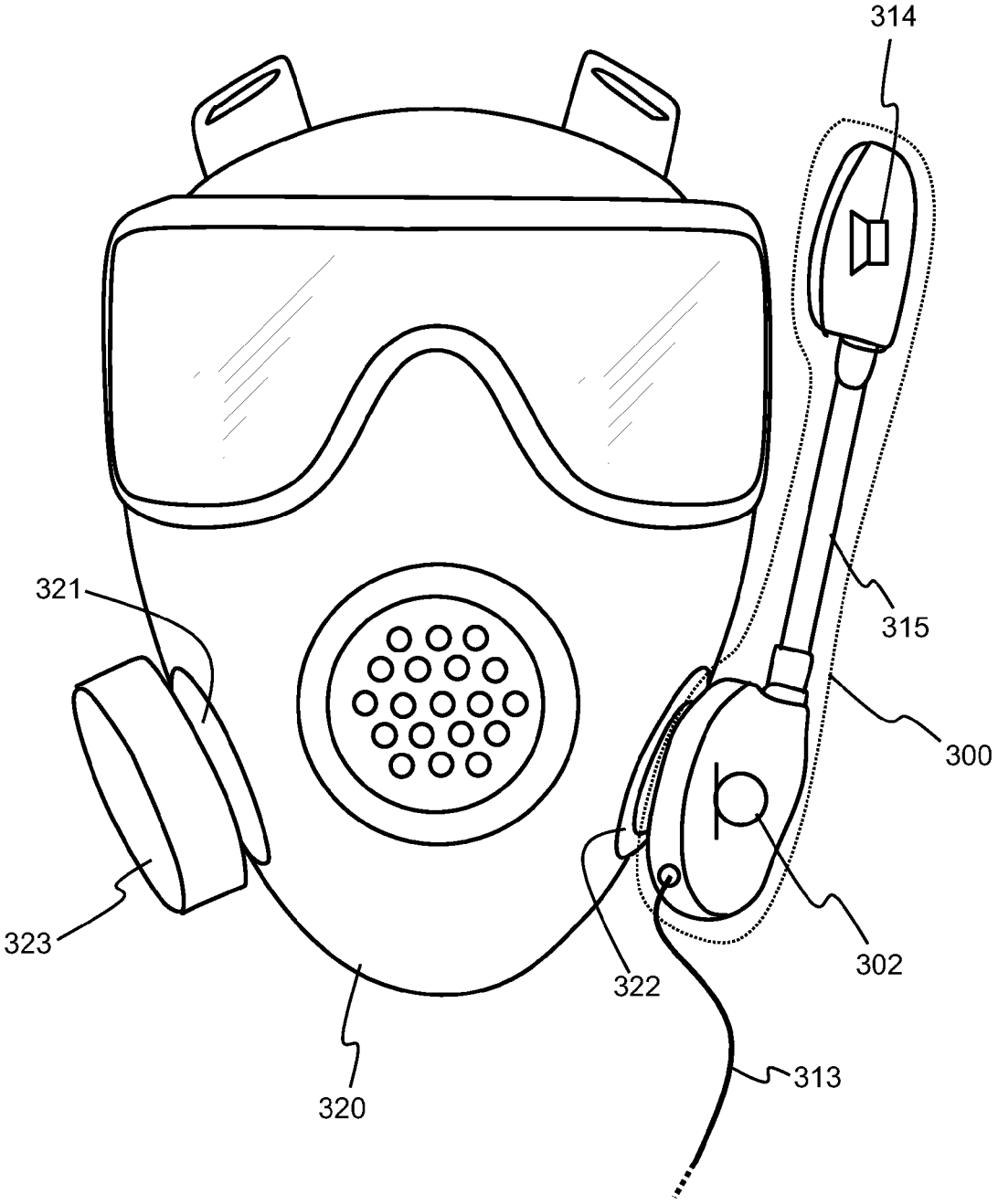

FIG. 3*b* illustrates an apparatus that comprise a breathing mask 320 and an electro-acoustical transducer device 300 according to another exemplifying embodiment of the invention. The electro-acoustical transducer device 300 has been screwed or otherwise releasably engaged onto the filter port 322 of the breathing mask. In addition to the differential microphone 302, the body structure, a possible acoustical resistor element or elements, and a possible vented cover, the electro-acoustical transducer device 300 further comprises a speaker element 314 and a mechanical support element 315 arranged to support the speaker element so that the speaker element is a distance apart from the differential microphone 302. The electro-acoustical transducer device 300 can be connected with the aid of the electrical wire 313 to an external device that can be, for example, a radio transceiver.

Figure 4A:
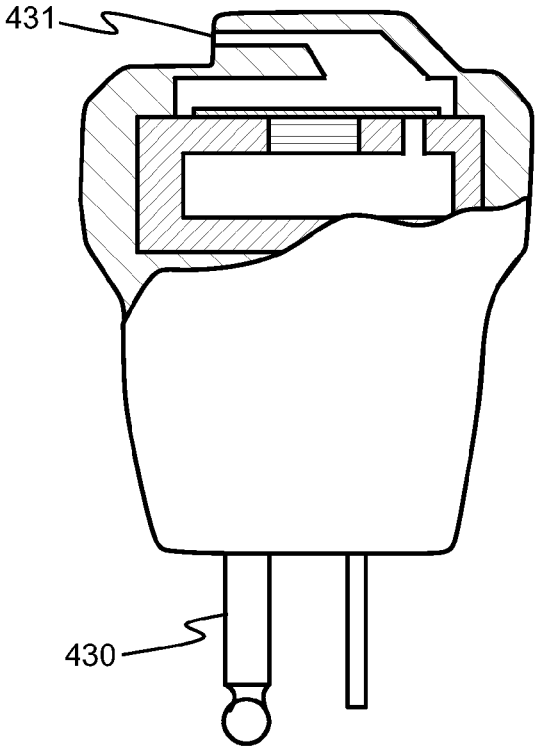
FIGS. 4*a* and 4*b* illustrate electro-acoustical transducer devices according to exemplifying embodiments of the invention.

FIG. 4*a* shows a partial section view of an electro-acoustical transducer device according to an exemplifying embodiment of the invention. The electro-acoustical transducer device comprises bayonet-style connectors 430 with the aid of which the electro-acoustical transducer device can be plugged to an external device, e.g. a radio transceiver. The acoustical signal is received via an opening 431.

Figure 4B:
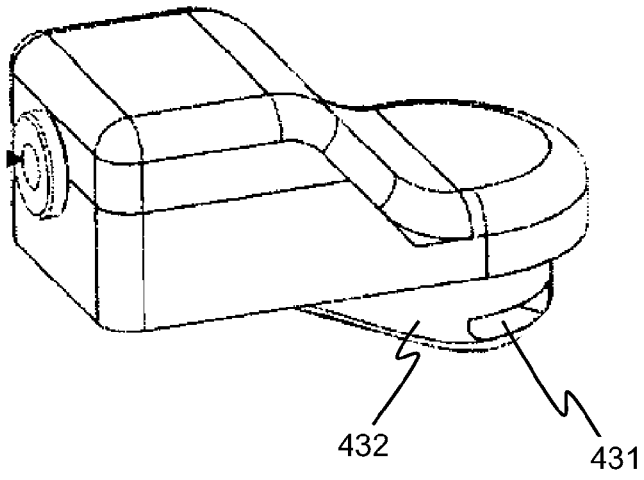

FIG. 4*b* shows a perspective view of an electro-acoustical transducer device according to an exemplifying embodiment of the invention. The electro-acoustical transducer device is suitable for use with generic half-masks and medical-style masks. A protruding part 432 can be mounted into a mounting hole of the mask and the acoustical signal is received via the opening 431 from the interior of the mask.

The specific examples provided in the description given above should not be construed as limiting. Therefore, the invention is not limited merely to the embodiments described above.

What is claimed is:

1. An electro-acoustical transducer device comprising:

a body structure, and a differential microphone located in an aperture of a first wall of the body structure, wherein:

the differential microphone comprises a front side for receiving an acoustical signal and a rear side for receiving the acoustical signal in modified form, the differential microphone is arranged to produce an electrical output signal substantially proportional to a difference of the acoustical signal at the front side and the acoustical signal at the rear side, the body structure is arranged to form a chamber shared with the rear side of the differential microphone, and there is at least one first tubular channel in the first wall of the body structure to the chamber so that the at least one first tubular channel and the chamber constitute an acoustical filter for filtering the acoustical signal falling to the rear side of the differential microphone, and wherein the electro-acoustical transducer device further comprises a vented cover element allowing both the front side of the differential microphone and the opening of the at least one first tubular channel to receive the acoustical signal in the same form.

2. An electro-acoustical transducer device according to claim 1, wherein the body structure is arranged to form at least one additional chamber and at least one second tubular channel between the chambers so that the chambers, the at least one first tubular channel, and the at least one second tubular channel constitute the acoustical filter.

3. An electro-acoustical transducer device according to claim 2, wherein the electro-acoustical transducer device further comprises an acoustical resistor element arranged to cover at least one of the following: the front side of the differential microphone, an opening of the at least one first tubular channel.

4. An electro-acoustical transducer device according to claim 1, wherein the electro-acoustical transducer device further comprises an acoustical resistor element arranged to cover at least one of the following: the front side of the differential microphone, an opening of the at least one first tubular channel.

5. An electro-acoustical transducer device according to claim 1, wherein the differential microphone is a noise-cancelling electret condenser microphone.

6. An electro-acoustical transducer device according to claim 1, wherein the differential microphone comprises two microphones arranged to receive acoustical signals from opposite sides of the first wall, and an electrical circuitry for forming a difference of electrical output signals of the two microphones.

7. An electro-acoustical transducer device according to claim 1, wherein the electro-acoustical transducer device comprises fastening elements for releasably engaging the electro-acoustical transducer device to an external device.

8. An electro-acoustical transducer device according to claim 7, wherein the fastening elements are threads on the surface of the body structure for releasably engaging the electro-acoustical transducer device to corresponding threads of a filter port of a breathing mask.

9. An electro-acoustical transducer device according to claim 8, wherein the electro-acoustical transducer device comprises a seal element for providing a gas-tight joint between the electro-acoustical transducer device and an external device.

10. An electro-acoustical transducer device according to claim 7, wherein the electro-acoustical transducer device comprises a seal element for providing a gas-tight joint between the electro-acoustical transducer device and an external device.

11. An electro-acoustical transducer device according to claim 1, wherein the electro-acoustical transducer device further comprises a speaker element and a mechanical support element arranged to support the speaker element relative to the body structure so that the speaker element is a distance apart from the differential microphone.

12. An apparatus comprising a breathing mask and an electro-acoustical transducer device engaged to the breathing mask, the electro-acoustical transducer device comprising:

a body structure, and a differential microphone located in an aperture of a first wall of the body structure, wherein the differential microphone comprises a front side for receiving an acoustical signal and a rear side for receiving the acoustical signal in modified form, the differential microphone is arranged to produce an electrical output signal substantially proportional to a difference of the acoustical signal at the front side and the acoustical signal at the rear side, the body structure is arranged to form a chamber shared with the rear side of the differential microphone, and there is at least one first tubular channel in the first wall of the body structure to the chamber so that the at least one first tubular channel and the chamber constitute an acoustical filter for filtering the acoustical signal falling to the rear side of the differential microphone, and wherein the electro-acoustical transducer device further comprises a vented cover element allowing both the front side of the differential microphone and the opening of the at least one first tubular channel to receive the acoustical signal in the same, undifferentiated form.

13. An apparatus according to claim 12, wherein the electro-acoustical transducer device has been screwed onto one of filter ports of the breathing mask.

* * * * *